US009818366B2

(12) United States Patent
Pyun

(10) Patent No.: US 9,818,366 B2
(45) Date of Patent: Nov. 14, 2017

(54) DISPLAY APPARATUS AND METHOD OF DRIVING THE DISPLAY APPARATUS

(71) Applicant: Samsung Display Co., Ltd., Yongin, Gyeonggi-Do (KR)

(72) Inventor: Ki-Hyun Pyun, Gwangmyeong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 247 days.

(21) Appl. No.: 14/546,142

(22) Filed: Nov. 18, 2014

(65) Prior Publication Data

US 2015/0364105 A1 Dec. 17, 2015

(30) Foreign Application Priority Data

Jun. 11, 2014 (KR) ..... 10-2014-0070632

(51) Int. Cl.
*G09G 3/36* (2006.01)

(52) U.S. Cl.
CPC ..... *G09G 3/3696* (2013.01); *G09G 3/3688* (2013.01); *G09G 2330/025* (2013.01); *G09G 2330/04* (2013.01); *G09G 2330/08* (2013.01)

(58) Field of Classification Search
CPC ..... G09G 3/3696; G09G 3/3688; G09G 2330/025; G09G 2330/04; G09G 2330/08
See application file for complete search history.

(56) References Cited

U.S. PATENT DOCUMENTS

| | | | | |
|---|---|---|---|---|
| 6,697,130 | B2 | 2/2004 | Weindorf et al. | |
| 6,825,828 | B2 | 11/2004 | Burke et al. | |
| 7,164,586 | B2 | 1/2007 | Lin | |
| 7,909,480 | B2 | 3/2011 | Kang et al. | |
| 7,956,979 | B2 | 6/2011 | Oh et al. | |
| 2008/0129903 | A1* | 6/2008 | Hong | G09G 3/3648 349/36 |
| 2009/0180048 | A1 | 7/2009 | Kim et al. | |
| 2014/0053105 | A1 | 2/2014 | Sakata et al. | |
| 2014/0084792 | A1* | 3/2014 | Oh | H05B 37/02 315/120 |
| 2014/0085289 | A1* | 3/2014 | Liang | G09G 3/3696 345/212 |

* cited by examiner

*Primary Examiner* — Peter D McLoone
(74) *Attorney, Agent, or Firm* — H.C. Park & Associates, PLC

(57) ABSTRACT

A display apparatus comprises a display panel including a plurality of data lines and a plurality of gate lines, a data driver circuit configured to convert image data to a grayscale voltage and to output the grayscale voltage to a data line, a voltage generator configured to provide the data driver circuit to a driving voltage, and a heat blocking circuit configured to compare a load current voltage with a reference voltage and to output a control signal for controlling the data driver circuit, the load current voltage being proportionate to a load current flowing toward the data driver circuit.

8 Claims, 6 Drawing Sheets

DISPLAY APPARATUS AND METHOD OF DRIVING THE DISPLAY APPARATUS

This application claims priority from and the benefit of Korean Patent Application No. 10-2014-0070632 filed on Jun. 11, 2014, which is hereby incorporated by reference for all purposes as if fully set forth herein.

BACKGROUND OF THE INVENTION

Field of the Invention

Exemplary embodiments of the present invention relate to a display apparatus and a method of driving the display apparatus. More particularly, exemplary embodiments of the present invention relate to a display apparatus for preventing a driver circuit from being damaged by heating and a method of driving the display apparatus.

Description of the Related Art

Generally, a liquid crystal display LCD apparatus has a relatively small thickness, low weight and low power consumption. Thus, the LCD apparatus is used in monitors, laptop computers and cellular phones, etc. The LCD apparatus includes an LCD panel displaying images using a selectively changeable light transmittance characteristic of a liquid crystal while a backlight assembly disposed under the LCD panel provides light to the LCD panel. A driving circuit drives the LCD panel and thereby causes selective changes in the light transmittance characteristic of the liquid crystals.

The liquid display panel includes an array substrate which has a plurality of gate lines, a plurality of crossing data lines, a plurality of thin film transistors and corresponding pixel electrodes. The liquid display panel also includes an opposing substrate which has a common electrode. A liquid crystal layer is interposed between the array substrate and opposing substrate. The driving circuit includes a gate driving part which drives the gate lines of the array substrate and a data driving part which drives the data lines.

Recently, the liquid display panel has become bigger in the size of a display area and higher in resolution, and thus load on the data driving circuit increases and heating occurs due to load increase. Thus, a circuit film may be burned by the heating of the data driving circuit.

SUMMARY OF THE INVENTION

Exemplary embodiments of the present invention provide a display apparatus which prevents a driver circuit from being damaged due to heating.

Exemplary embodiments of the present invention provide a method of driving the display apparatus.

According to an exemplary embodiment of the present invention, there is provided a display apparatus. The display apparatus comprises a display panel including a plurality of data lines and a plurality of gate lines, a data driver circuit configured to convert image data to a grayscale voltage and to output the grayscale voltage to a data line, a voltage generator configured to provide a driving voltage to the data driver circuit, and a heat blocking circuit configured to compare a load current voltage with a reference voltage and to output a control signal for controlling the data driver circuit, the load current voltage being proportionate to a load current flowing toward the data driver circuit.

In an exemplary embodiment of the present invention, the heat blocking circuit may include a current monitor configured to output the load current voltage which is proportionate to the load current flowing toward the data driver circuit, and a driving controller configured to compare the load current voltage with a reference voltage and to output the control signal.

In an exemplary embodiment of the present invention, the current monitor may include an operational amplifier comprising a non-inverting terminal connected to a voltage line, which is connected to the voltage generator and transfers the driving voltage through a first resistor, an inverting terminal connected to the voltage line through a second resistor, and a monitor transistor connected to an output terminal of the operational amplifier and the non-inverting terminal, and configured to output the load current voltage.

In an exemplary embodiment of the present invention, the current monitor may further include a capacitor connected in parallel with the second resistor.

In an exemplary embodiment of the present invention, the driving controller may comprise a comparator including a non-inverting terminal which is configured to receive the load current voltage and an inverting terminal which is configured to receive the reference voltage, and a control transistor connected to an output terminal of the comparator and configured to output the control signal having a high level or a low level in response to an output voltage of the comparator.

In an exemplary embodiment of the present invention, the driving voltage may be an analog source voltage, the grayscale voltage being generated using the analog source voltage.

In an exemplary embodiment of the present invention, the display apparatus may further include a timing controller configured to provide the data driver circuit with the image data, wherein the control signal may be applied to a reset terminal of the timing controller and the timing controller may control an output of the image data based on the control signal.

In an exemplary embodiment of the present invention, when the load current voltage is more than the reference voltage, the timing controller may be shut down and the output of the image data is blocked.

In an exemplary embodiment of the present invention, the control signal may be concurrently applied to a reset terminal of the timing controller and an enable terminal of the voltage generator.

In an exemplary embodiment of the present invention, the control signal may be applied to the enable terminal of the voltage generator and the voltage generator controls an output of the driving voltage based on the control signal.

In an exemplary embodiment of the present invention, when the load current voltage is more than the reference voltage, the voltage generator may be shut down and the output of the driving voltage is blocked.

According to an exemplary embodiment of the present invention, there is provided a method of driving a display apparatus which includes a display panel comprising a plurality of data lines and a plurality of gate lines. The method comprises converting image data of a digital signal to a grayscale voltage of an analog signal using a driving voltage, outputting the grayscale voltage to a data line of the display panel, outputting a load current voltage which is proportionate to a load current flowing through a voltage line which transfers the driving voltage, comparing the load current voltage with a reference voltage to generate a control signal, and controlling generation of the grayscale voltage based on the control signal.

In an exemplary embodiment of the present invention, the driving voltage may be an analog source voltage, the grayscale voltage being generated using the analog source voltage.

In an exemplary embodiment of the present invention, the method may further include blocking an output of the analog source voltage used for generating the grayscale voltage when the load current voltage is more than the reference voltage.

In an exemplary embodiment of the present invention, the method may further include blocking all outputs of the analog source voltage and the image data for generating the grayscale voltage when the load current voltage is more than the reference voltage.

In an exemplary embodiment of the present invention, the method may further include blocking an output of the image data used for generating the grayscale voltage when the load current voltage is more than the reference voltage.

According to the present invention, the load current voltage which is proportionate to the load current which flows toward the data driver circuit is detected by the data driver circuit, and thus, when the load current voltage is more than the reference voltage due to the load increase of the data driver circuit, the data driver circuit shuts down. Therefore, the data driver circuit may be prevented from being damaged by the load increase.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Hereinafter, the present invention will be explained in detail with reference to the accompanying drawings.

Figure 1:
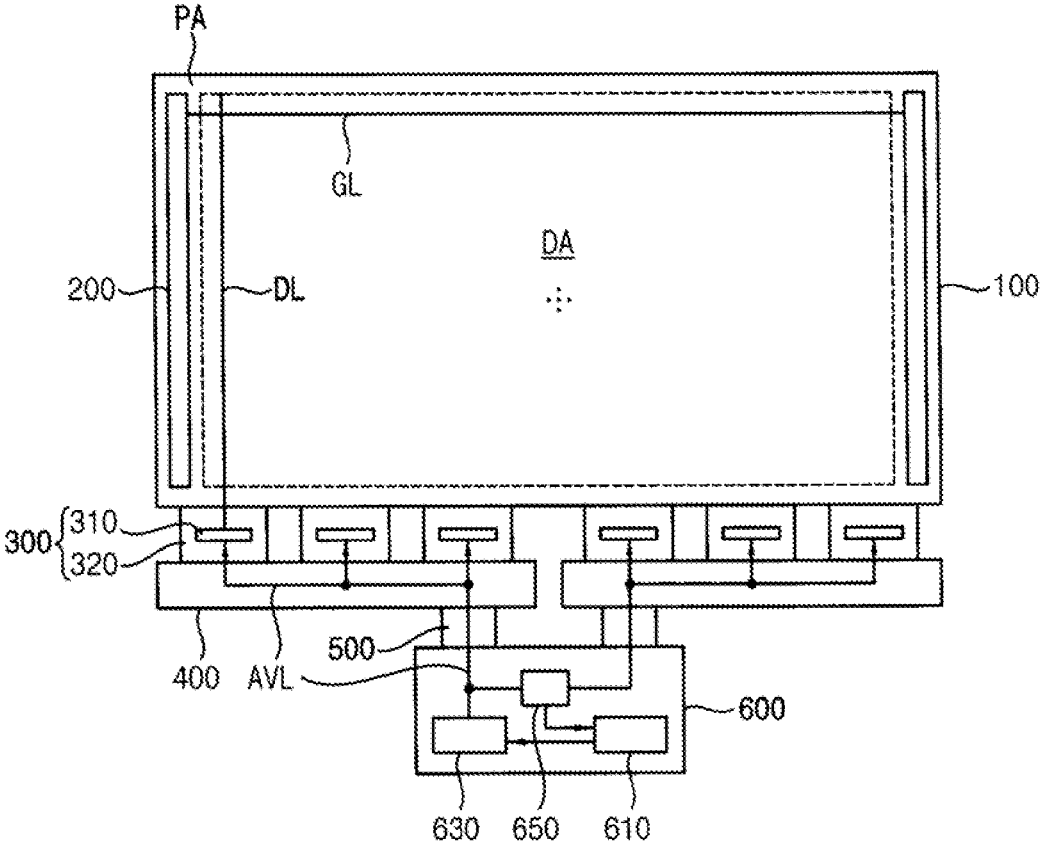
FIG. 1 is a plan view illustrating a display apparatus according to a first exemplary embodiment of the present invention.

FIG. 1 is a plan view illustrating a display apparatus according to a first exemplary embodiment of the present invention.

Referring to FIG. 1, the display apparatus may include a display panel 100, a gate driver circuit 200, a data driver circuit 300, a source printed circuit board 400, a connection member 500, and a control printed circuit board 600 including a timing controller 610, a voltage generator 630, and a heat blocking circuit 650.

The display panel 100 may include a plurality of gate lines GL and a plurality of data lines DL crossing the plurality of gate lines GL. The display panel 100 includes a display area DA in which a plurality of pixels is arranged and a peripheral area PA which surrounds the display area DA.

The gate driver circuit 200 is configured to drive the gate lines GL, and is disposed in the peripheral area PA of the display panel 100. The gate driver circuit 200 may be directly integrated in the peripheral area PA, or it may be a gate circuit film which includes a gate driver chip. The display apparatus includes at least one gate driver circuit 200. The gate driver circuit 200 is configured to generate a plurality of gate signals and to sequentially provide the plurality of gate signals to the plurality of gate lines GL.

The data driver circuit 300 is configured to drive the data lines DL. The data driver circuit 300 may be a data circuit film 320 including a data driver chip 310. A first end portion of the data circuit film 320 is mounted on the peripheral area PA of the display panel 100 and a second end portion of the data circuit film 320 is mounted on the source printed circuit board 400. The display apparatus includes at least one data driver circuit 300.

The data driver circuit 300 is configured to convert image data of a digital signal to a grayscale voltage of an analog signal, and to provide the plurality of data lines DL with the grayscale voltage.

A second end portion of the data driver circuit 300 is mounted on the source printed circuit board 400. The source printed circuit board 400 includes a plurality of signal lines which transfers a plurality of driving signals to the data driver circuit 300 and the gate driver circuit 200. The display apparatus may include at least one source printed circuit board 400.

A first end portion of the connection member 500 is connected to the source printed circuit board 400 and a second end portion of the connection member 500 is connected to the control printed circuit board 600. The display apparatus may include at least one connection member 500.

The control printed circuit board 600 includes the timing controller 610, the voltage generator 630 and the heat blocking circuit 650 which are mounted thereon.

The timing controller 610 is configured to generally control operation of the display apparatus. The timing controller 610 is configured to provide the gate driver circuit 200, the data driver circuit 300 and the voltage generator 630 with driving control signals to control those elements. In addition, the timing controller 610 is configured to provide the data driver circuit 300 with the image data of the digital signal.

The voltage generator 630 is configured to generate driving voltages for driving the gate driver circuit 200 and the data driver circuit 300. The driving voltages include gate-on voltage and gate-off voltage for the gate driver circuit 200 and analog source voltage AVDD and digital source voltage DVDD for the data driver circuit 300. The gate-on voltage corresponds to a high level of a gate signal, and the gate-off voltage corresponds to a low level of the gate signal. The analog source voltage AVDD is used for generating the grayscale voltage. The digital source voltage DVDD is used for driving the data driver circuit 300.

The analog source voltage AVDD is transferred to the data driver circuit 300 through a source voltage line AVL which is disposed on the control printed circuit board 600, the connection member 500, the source printed circuit board 400 and the data circuit film 320.

The heat blocking circuit 650 prevents the data driver circuit 300 from being heated by a load increase in the data driver circuit 300 by an abnormal signal such as static electricity, an abnormal condition such as film damage, and the like. The heat blocking circuit 650 is connected to the source voltage line AVL for transferring the analog source voltage AVDD which has a highest level and a great level transition among source driving voltages applied to the data driver circuit 300. The heat blocking circuit 650 is configured to detect a load current voltage which is proportionate to a load current and which flows toward the data driver circuit 300. The heat blocking circuit 650 is configured to generate a control signal for blocking, in a compulsory manner, an output of the data driver circuit 300 when the load current voltage is more than a reference voltage. When the load current voltage is more than the reference voltage, this is a case in which the load of the data driver circuit 300 is out of an allowable range.

In an exemplary embodiment of the present invention, the control signal is applied to a reset terminal of the timing controller 610. When the timing controller 610 receives the control signal corresponding to a condition of the load increase in the data driver circuit 300, the timing controller 610 is shut down in a compulsory manner. Thus, the image data applied to the data driver circuit 300 is blocked, and therefore the data driver circuit 300 does not generate the grayscale voltage and the output of the data driver circuit 300 is stopped. Operation of the data driver circuit 300 is stopped, and thus the data driver circuit 300 is prevented from being heated by the load increase.

Figure 2:
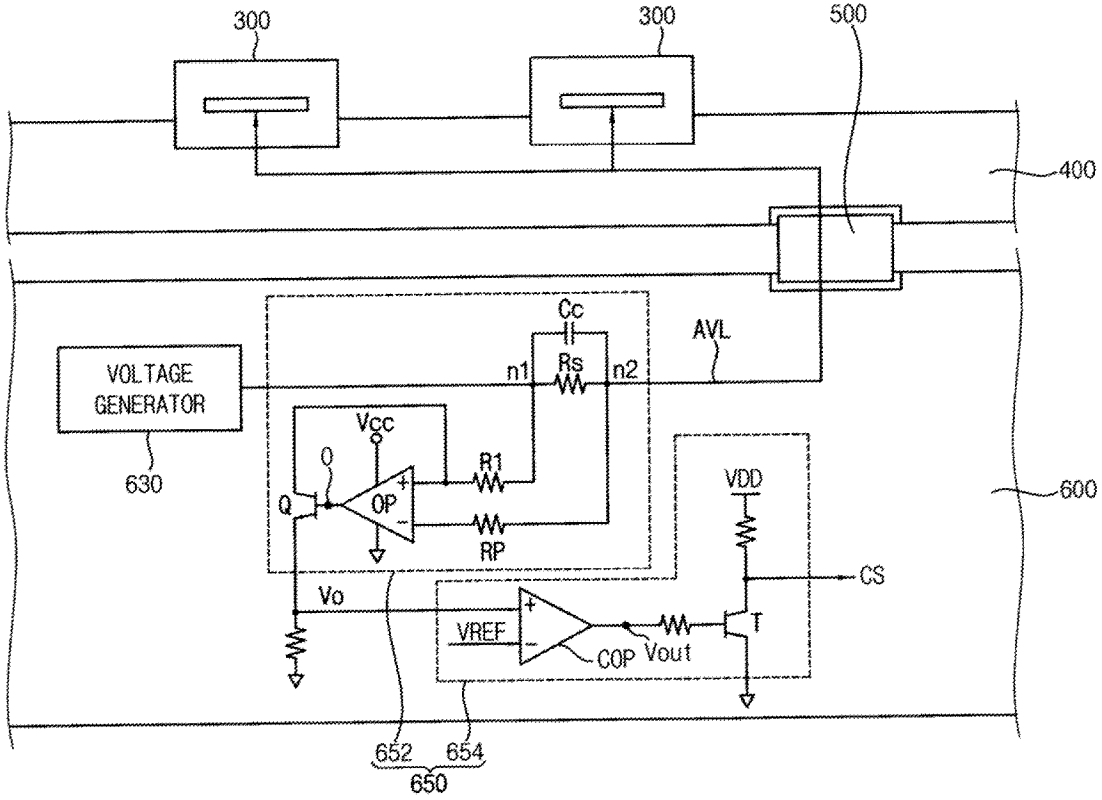
FIG. 2 is a conceptual diagram illustrating a heat blocking circuit of FIG. 1.

FIG. 2 is a conceptual diagram illustrating a heat blocking circuit of FIG. 1.

Referring to FIGS. 1 and 2, the heat blocking circuit 650 may include a current monitor 652 and a driving controller 654.

The current monitor 652 may include an operational amplifier OP and a monitor transistor Q.

The operational amplifier OP includes input terminals + and −, and an output terminal O.

The input terminals of the operational amplifier OP include a non-inverting terminal + and an inverting terminal −. The non-inverting terminal + and inverting terminal − are connected to an output terminal of the voltage generator 630.

The non-inverting terminal + is connected to a first node n1 which is connected to the output terminal of the voltage generator 630 through a first resistor R1. The inverting terminal − is connected to the first node n1 through a second node n2 and a second resistor Rs. A first end portion of the second resistor Rs is connected to the first node n1 and a second end portion the second resistor Rs is connected to a second node n2. The second node n2 is disposed adjacent to the connection member 500 which is connected to the data driver circuit 300.

The current monitor 652 may further include a capacitor Cc which is connected in parallel with the second resistor Rs which is disposed between the first node n1 and the second node n2. The capacitor Cc generally blocks a direct current (DC) and passes an alternating current (AC). Two input terminals of the operational amplifier OP are opened with respect to the DC and are shorted with respect to the AC, such as noise having a frequency, by the capacitor Cc. Thus, the noise applied to the two input terminals of the operational amplifier OP may be decreased by operating characteristics which remove a common noise. The analog source voltage AVDD of the DC may be stabilized by the capacitor Cc.

The current monitor 652 may further include a third resistor Rp which is connected between the second node n2 and the inverting terminal −. The third resistor Rp is directly and internally connected to the operational amplifier OP. When the load of the source voltage line AVL is increased, a voltage of the non-inverting terminal − may be greatly changed. Thus, the operational amplifier OP may be stabilized by the third resistor Rp when the load of the source voltage line AVL is increased, and the voltage of the non-inverting terminal − may be greatly changed.

The monitor transistor Q is connected to an output terminal O of the operational amplifier OP. The monitor transistor Q includes a control electrode which is connected to the output terminal O of the operational amplifier OP, an input electrode which is connected to the non-inverting terminal + of the operational amplifier OP, and an output electrode which provides a load current voltage Vo.

The current monitor 652 outputs the load current voltage Vo which is proportionate to a load current which flows toward the data driver circuit 300.

The driving controller 654 includes a comparator COP and a control transistor T.

The comparator COP includes a non-inverting terminal + and an inverting terminal −. The non-inverting terminal + is configured to receive the load current voltage Vo from the current monitor 652. The inverting terminal − is configured to receive a reference voltage VREF.

When the load current voltage Vo applied to the non-inverting terminal + of the comparator COP is more than the reference voltage VREF applied to the inverting terminal − of the comparator COP, the comparator COP is configured to output an output voltage Vout of a high level. Conversely, when the load current voltage Vo is less than the reference voltage VREF, the comparator COP is configured to output an output voltage Vout of a low level.

The control transistor T includes a control electrode which receives the output voltage Vout of the comparator COP, an input electrode which receives a source voltage VDD and an output electrode which receives a ground voltage.

When the load current voltage Vo is more than the reference voltage VREF, the control transistor T turns on in response to the output voltage Vout having the high level, and control transistor T outputs the ground voltage which is a control signal CS having a low level.

Conversely, when the load current voltage Vo is less than the reference voltage VREF, the control transistor T turns off in response to the output voltage Vout having the low level, and control transistor T outputs the source voltage which is the control signal CS having a high level.

The control signal CS outputted from the driving controller 654 is applied to the reset terminal of the timing controller 610 of FIG. 1. Thus, when the control signal CS of the low level is applied to the reset terminal, the timing controller 610 is shut down in a compulsory manner. Conversely, when the control signal CS of the high level is applied to the reset terminal, the timing controller 610 is normally driven.

When the driving controller 654 outputs the control signal CS of the low level, the load current flowing toward the data driver circuit 300 is out of the allowable range, that is, this is a case in which the load of the data driver circuit 300 increases.

As described above, when the load of the data driver circuit 300 increases, the timing controller 610 is shut down, and thus the output of the image data applied to the data driver circuit 300 is stopped. Thus, the output of the data driver circuit 300 is stopped in a compulsory manner, and thus the data driver circuit 300 is prevented from being heated by the load increase.

Figure 3:
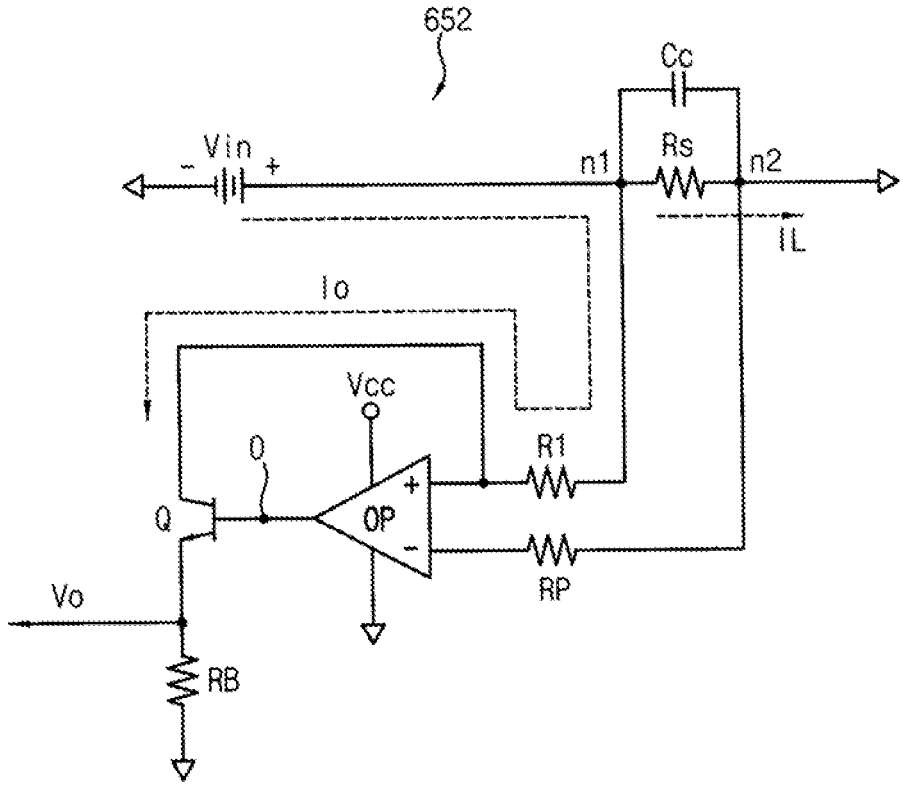
FIG. 3 is a circuit diagram illustrating a current monitor of FIG. 1.

FIG. 3 is a circuit diagram illustrating a current monitor of FIG. 1

Referring to FIGS. 2 and 3, a method of driving the current monitor 652 is explained. The current monitor 652 includes the operational amplifier OP and the monitor transistor Q.

In order to obtain a voltage Vo applied to the output terminal of the operational amplifier OP, a non-inverting voltage V+ applied to the non-inverting terminal + and a inverting voltage V− applied to the inverting terminal − may be respectively defined as the following Expression 1.

$$V_+ = V_{in} - (I_o \times R_1)$$

$$V_- = V_{in} - (I_L \times R_s) \qquad \text{Expression 1}$$

An input impedance of the operational amplifier OP is an infinite quantity, and thus a current may be divided into an output current Io which flows along a feedback route from the non-inverting terminal + of the operational amplifier OP toward the output terminal of the operational amplifier OP, and a load current IL which flows toward the data driver circuit 300 of FIG. 2.

Referring to Expression 1, the non-inverting voltage V+ may be defined to be a difference voltage between an input voltage Vin and a dropped voltage (Io×R1) dropped by the first resistor R1, and the inverting voltage V− may be defined to be a difference voltage between the input voltage Vin and a dropped voltage (IL×Rs) dropped by the second resistor R2. Herein, the first resistor R1 may be about 10 ohms and the second resistor Rs may be about 0.1 ohms.

The non-inverting voltage V+ is always more than the inverting voltage V−, and thus the operational amplifier OP outputs a voltage having a polarity the same as that of the non-inverting voltage V+ applied to the non-inverting terminal through the output terminal. Thus, the monitor transistor Q may always turn on.

According to performance characteristics of the operational amplifier OP, the load current voltage Vo applied to the output terminal of the current monitor 652 may be defined as the following Expression 2 on condition that offset voltages of the non-inverting voltage V+ applied to the non-inverting terminal and the inverting voltage applied to the inverting terminal are equal to each other.

$$V_+ = V_- \qquad \text{Expression 2}$$

$$V_{in+} - (I_o \times R_1) = V_{in+} - (I_L \times R_s)$$

$$(I_o \times R_1) = (I_L \times R_s),$$

$$(V_o / R_B \times R_1) = (I_L \times R_s), \; [vI_o = V_o / R_B]$$

$$\therefore \; V_o = \frac{(I_L \times R_s \times R_B)}{R_1}$$

Referring to Expression 2, the load current voltage Vo outputted from the current monitor 652 is proportionate to the load current IL. Thus, the load current voltage Vo may be increased when the load current IL is increased.

The load current voltage Vo proportionate to the load current IL is applied to the driving controller 654.

The driving controller 654 is configured to compare the load current voltage Vo to the reference voltage which is preset based on the allowable range of the load current, and to generate the control signal CS to control whether the data driver circuit 300 normally drives or is shut down in a compulsory manner.

Figure 4:
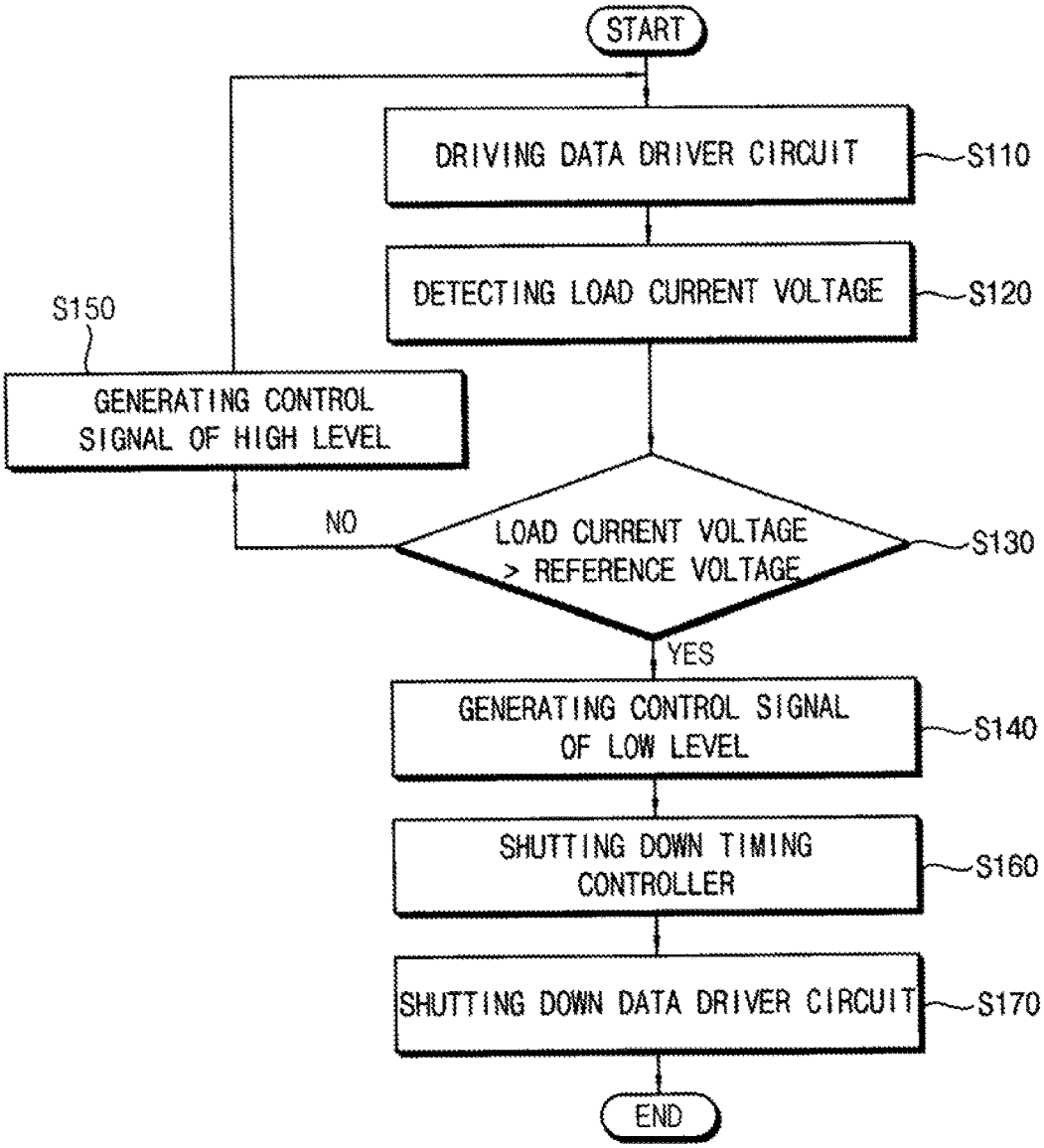
FIG. 4 is a flowchart illustrating a method of driving the display apparatus of FIG. 1.

FIG. 4 is a flowchart illustrating a method of driving the display apparatus of FIG. 1.

Referring to FIGS. 2 and 4, when the display apparatus drives, the data driver circuit 300 is driven based on control of the timing controller 610 (Step S110). For example, the data driver circuit 300 is configured to receive image data of a digital signal from the timing controller 610 and an analog source voltage AVDD of an analog signal from the voltage generator 630. The data driver circuit 300 is configured to generate a grayscale voltage of the analog signal using the analog source voltage AVDD and to output the grayscale voltage to a data line of the display panel 100.

The current monitor 652 is configured to detect a load current voltage Vo proportionate to a load current which flows through the source voltage line AVL transferring the analog source voltage AVDD to the data driver circuit 300 (Step S120).

Referring to FIG. 3, an input impedance of the operational amplifier OP is an infinite quantity, and thus a current which flows through the source voltage line AVL transferring the analog source voltage AVDD may be divided into an output current Io which flows along a feedback route of the operational amplifier OP and a load current IL which flows toward the data driver circuit 300.

Referring to Expression 1, the non-inverting voltage V+ may be defined as a difference voltage between the analog source voltage AVDD that is an input voltage Vin and a dropped voltage (Io×R1) dropped by the first resistor R1, and the inverting voltage V− may be defined as a difference voltage between the analog source voltage AVDD and a dropped voltage (IL×Rs) dropped by the second resistor R2. Herein, the first resistor R1 may be about 10 ohms and the second resistor Rs may be about 0.1 ohms.

The non-inverting voltage V+ is always more than the inverting voltage V−, and thus the operational amplifier OP outputs a voltage having a polarity the same as the non-inverting voltage V+ applied to the non-inverting terminal through the output terminal. Thus, the monitor transistor Q may always turn on.

Referring to Expression 2, the load current voltage Vo outputted from the current monitor 652 is proportionate to the load current IL. Thus, the load current voltage Vo may be increased when the load current IL is increased.

The load current voltage Vo is applied to the comparator COP of the driving controller 654. The non-inverting terminal + of the comparator COP receives the load current voltage Vo, and the inverting terminal − of the comparator COP receives the reference voltage VREF.

When the load current voltage Vo is more than the reference voltage VREF (Step S130), the comparator COP is configured to output an output voltage Vout of a high level. The control transistor T turns on in response to the output voltage Vout of the high level and outputs a control signal CS of a low level corresponding to a ground voltage (Step S140).

In other words, when the control signal CS of the low level is outputted from the driving controller 654, this is a case in which the load of the data driver circuit 300 is out of the allowable range.

The control signal CS of the low level is applied to the reset terminal of the timing controller 610. As a result, the timing controller 610 is shut down in response to the control signal CS of the low level (Step S160).

Operation of the timing controller 610 is stopped. Therefore, an output of the image data applied to the data driver circuit 300 is blocked, and thus the data driver circuit 300 does not generate the grayscale voltage (Stop S170). Therefore, the data driver circuit 300 is shut down in a compulsory manner, and thus the data driver circuit 300 may be prevented from being heated by the load increase.

However, when the load current voltage Vo is less than the reference voltage VREF (Step S130), the comparator COP is configured to output the output voltage Vout of a low level. The control transistor T turns off in response to the output voltage Vout of the low level, and outputs the control signal CS of a high level corresponding to the source voltage VDD (Step S150).

In other words, when the control signal CS of the high level is outputted from the driving controller 654, this is a case in which the load of the data driver circuit 300 is in the allowable range.

The control signal CS of the high level is applied to the reset terminal of the timing controller 610. Thus, the timing controller 610 normally drives and the data driver circuit 300 also normally drives.

Figure 5:
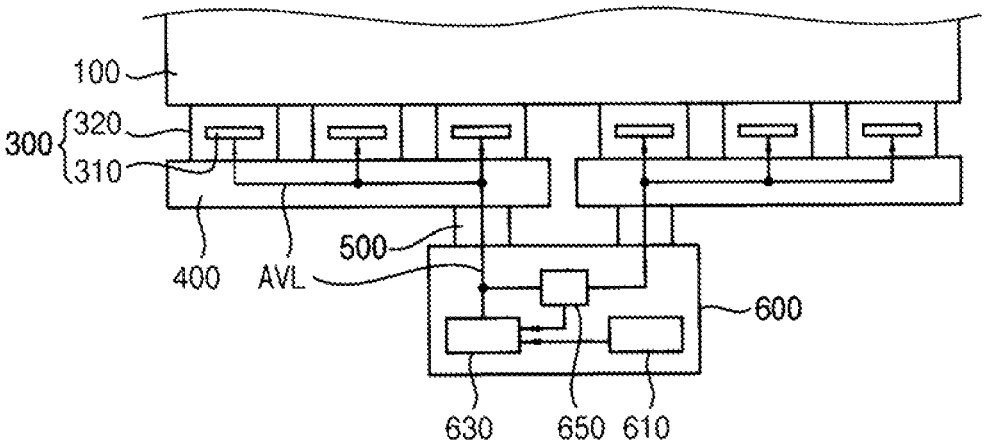
FIG. 5 is a plan view illustrating a display apparatus according to a second exemplary embodiment of the present invention.

FIG. 5 is a plan view illustrating a display apparatus according to a second exemplary embodiment of the present invention.

Hereinafter, the same reference numerals are used to refer to the same or like parts as those described in the previous exemplary embodiment, and the same detailed explanations are not repeated unless necessary.

Referring to FIG. 5, the display apparatus may include a display panel 100, a gate driver circuit 200, a data driver circuit 300, a source printed circuit board 400, a connection member 500, and a control printed circuit board 600 including a timing controller 610, a voltage generator 630 and a heat blocking circuit 650.

The control printed circuit board 600 may include the timing controller 610, the voltage generator 630 and the heat blocking circuit 650 which are mounted thereon.

The timing controller 610 is configured to generally control the operation of the display apparatus. The timing controller 610 is configured to provide the gate driver circuit 200, the data driver circuit 300 and the voltage generator 630 with driving control signals to control those elements. In addition, the timing controller 610 is configured to provide the data driver circuit 300 with the image data of the digital signal.

The voltage generator 630 is configured to generate driving voltages for driving the gate driver circuit 200 and the data driver circuit 300. The driving voltages include gate-on voltage and gate-off voltage for driving the gate driver circuit 200 and analog source voltage AVDD and digital source voltage DVDD for driving the data driver circuit 300. The gate-on voltage corresponds to a high level of a gate signal, and the gate-off voltage corresponds to a low level of the gate signal. The analog source voltage AVDD is used for generating the grayscale voltage. The digital source voltage DVDD is used for driving the data driver circuit 300.

The analog source voltage AVDD is transferred to the data driver circuit 300 through a source voltage line AVL which is disposed on the control printed circuit board 600, the connection member 500, the source printed circuit board 400 and the data circuit film 320.

The heat blocking circuit 650 prevents an increase in the load of the data driver circuit 300 by an abnormal signal. The heat blocking circuit 650 is connected to the source voltage line AVL which transfers the analog source voltage AVDD, having a highest level and a great level transition among source driving voltages, to the data driver circuit 300. The heat blocking circuit 650 is configured to detect a load current voltage which is proportionate to a load current which flows toward the data driver circuit 300. The heat blocking circuit 650 is configured to generate a control signal for blocking an output of the data driver circuit 300 in a compulsory manner when the load current voltage is more than a reference voltage.

In an exemplary embodiment of the present invention, the control signal is applied to an enable terminal of the voltage generator 630. When the voltage generator 630 receives the control signal which corresponds to a condition of a load increase in the data driver circuit 300, the voltage generator 630 is shut down in a compulsory manner. As a result, the analog source voltage AVDD applied to the data driver circuit 300 is blocked, and thus the data driver circuit 300 does not generate the grayscale voltage and the output of the data driver circuit 300 is stopped. The operation of the data driver circuit 300 is stopped, and thus the data driver circuit 300 is prevented from being heated by a load increase.

Figure 6:
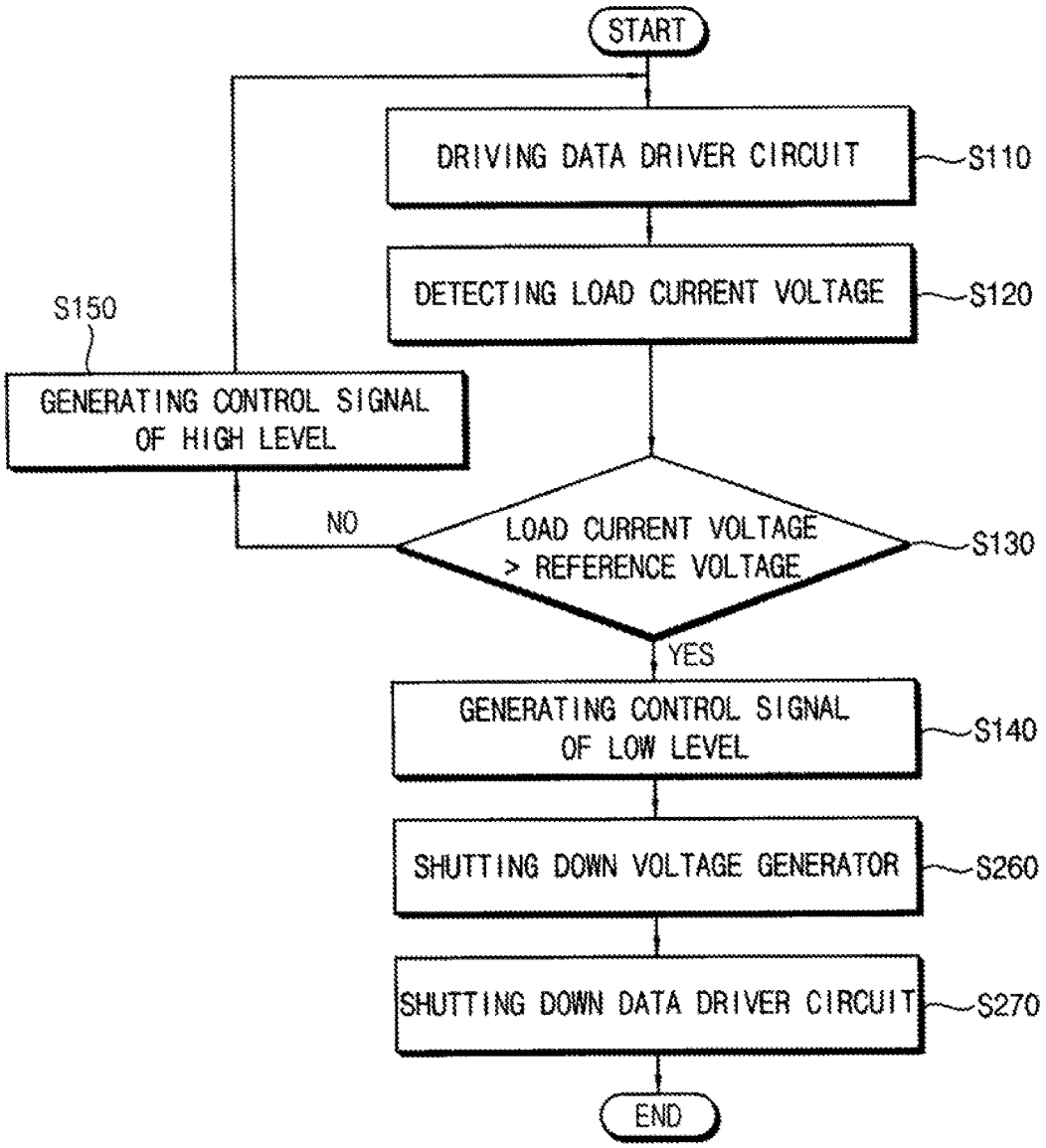
FIG. 6 is a flowchart illustrating a method of driving the display apparatus of FIG. 5.

FIG. 6 is a flowchart illustrating a method of driving the display apparatus of FIG. 5.

Referring to FIGS. 5 and 6, when the display apparatus is driven, the data driver circuit 300 is driven based on control of the timing controller 610 (Step S110). For example, the data driver circuit 300 is configured to receive image data of a digital signal from the timing controller 610 and an analog source voltage AVDD of an analog signal from the voltage generator 630. The data driver circuit 300 is configured to generate a grayscale voltage of the analog signal using the analog source voltage AVDD, and to output the grayscale voltage to the data line of the display panel.

The current monitor 652 (FIG. 2) of the heat blocking circuit 650 is configured to output a load current voltage Vo proportionate to a load current which flows through the source voltage line AVL transferring the analog source voltage AVDD to the data driver circuit 300 (Step S120).

Referring to FIG. 3, an input impedance of the operational amplifier OP is an infinite quantity, and thus a current which flows through the source voltage line AVL transferring the analog source voltage AVDD may be divided into an output current Io which flows through a feedback route of the Operational amplifier OP and a load current IL which flows toward the data driver circuit 300.

Referring to Expression 1 (set forth and discussed above), the non-inverting voltage V+ may be defined as a difference voltage between the analog source voltage AVDD that is an input voltage Vin and a dropped voltage (Io×R1) dropped by the first resistor R1, and the inverting voltage V− may be defined as a difference voltage between the analog source voltage AVDD and a dropped voltage (IL×Rs) dropped by the second resistor R2. Herein, the first resistor R1 may be about 10 ohms and the second resistor Rs may be about 0.1 ohms.

The non-inverting voltage V+ is always more than the inverting voltage V−, and thus the operational amplifier OP outputs a voltage having a polarity as that of the non-inverting voltage V+ applied to the non-inverting terminal through the output terminal. Thus, the monitor transistor Q may always turn on.

Referring to Expression 2 (set forth and discussed above), the load current voltage Vo outputted from the current monitor 652 is proportionate to the load current IL according to performance characteristics of the operational amplifier OP. Thus, the load current voltage Vo may be increased when the load current IL increases.

The load current voltage Vo is applied to the comparator COP of the driving controller 654. The non-inverting terminal + of the comparator COP receives the load current voltage Vo and the inverting terminal − of the comparator COP receives the reference voltage VREF.

When the load current voltage Vo is more than the reference voltage VREF (Step S130 of FIG. 6), the comparator COP is configured to output an output voltage Vout of a high level. The control transistor T of FIG. 2 turns on in response to the output voltage Vout of a high level and outputs a control signal CS of a low level corresponding to a ground voltage (Step S140 of FIG. 6).

In other words, when the control signal CS of a low level outputted from the driving controller 654, this is a case in which the load of the data driver circuit 300 is out of the allowable range.

The control signal CS of the low level is applied to the enable terminal of the voltage generator 630. Thus, the voltage generator 630 is shut down in response to the control signal CS of the low level (Step S260).

Operation of the voltage generator 630 is stopped, and thus the analog source voltage AVDD, which is a driving voltage applied to the data driver circuit 300, is blocked. Thus, the data driver circuit 300 does not generate the grayscale voltage (Stop S270). Therefore, the data driver circuit 300 is shut down in a compulsory manner, and thus the data driver circuit 300 is prevented from being heated by a load increase.

However, when the load current voltage Vo is less than the reference voltage VREF (Step S130), the comparator COP is configured to output the output voltage Vout of a low level. The control transistor T of FIG. 2 turns off in response to the output voltage Vout of the low level, and outputs the control signal CS of a high level corresponding to the source voltage VDD (Step S150).

In other words, when the control signal CS of the high level is outputted from the driving controller 654, this is a case in which the load of the data driver circuit 300 is in the allowable range.

The control signal CS of the high level is applied to the enable terminal of the voltage generator 630. Thus, the voltage generator 630 normally drives and the data driver circuit 300 also normally drives.

Although not shown in the figures, the control signal outputted from the driving controller 654 may be concurrently applied to both the reset terminal of the timing controller 610 and the enable terminal of the voltage generator 630. Thus, when the load of the data driver circuit 300 is out of the allowable range, the timing controller 610 and the voltage generator 630 may be concurrently shut down. Accordingly, the data driver circuit 300 is shut down in a compulsory manner, and thus the data driver circuit 300 may be prevented from being heated by a load increase.

As described above, according to exemplary embodiments of the present invention, the load current voltage proportionate to the load current which flows toward the data driver circuit is detected by the data driver circuit, and thus when the load current voltage is more than the reference voltage by the load increase in the data driver circuit, the data driver circuit shuts down. Therefore, the data driver circuit may be prevented from being damaged by the load increase.

The foregoing is illustrative of the present invention and is not to be construed as limiting thereof. Although two exemplary embodiments of the present invention have been described, those skilled in the art will readily appreciate that many modifications are possible in the exemplary embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and structural equivalents, but also equivalent structures. Therefore, it is to be understood that the foregoing is illustrative of the present invention and is not to be construed as limited to the specific exemplary embodiments disclosed herein, and that modifications to the disclosed exemplary embodiments, as well as other exemplary embodiments, are intended to be included within the scope of the appended claims. The present invention is defined by the following claims, with equivalents of the claims to be included therein.

What is claimed is:

1. A display apparatus, comprising:

a display panel including a plurality of data lines and a plurality of gate lines;

a data driver circuit for converting image data to a grayscale voltage and for outputting the grayscale voltage to a data line;

a voltage generator for providing a driving voltage to the data driver circuit;

a heat blocking circuit for comparing a load current voltage to a reference voltage, and for outputting a control signal for controlling the data driver circuit, the load current voltage being proportionate to a load current flowing toward the data driver circuit; and a timing controller for providing the data driver circuit with the image data, wherein when the load current voltage is more than the reference voltage, the timing controller is shut down and the output of the image data is blocked, wherein the heat blocking circuit comprises:

a current monitor for outputting the load current voltage which is proportionate to the load current flowing toward the data driver circuit; and a driving controller for comparing the load current voltage with the reference voltage, and for outputting the control signal, wherein the current monitor comprises:

an operational amplifier including a non-inverting terminal connected to a voltage line which is connected to the voltage generator and transfers the driving voltage through a first resistor, and an inverting terminal connected to the voltage line through a second resistor; and a monitor transistor connected to an output terminal of the operational amplifier and to the non-inverting terminal, and for outputting the load current voltage.

2. The display apparatus of claim 1, wherein the current monitor further comprises a capacitor which is connected in parallel with the second resistor.

3. The display apparatus of claim 1, wherein the driving controller comprises:

a comparator including a non-inverting terminal for receiving the load current voltage and an inverting terminal for receiving the reference voltage; and a control transistor connected to an output terminal of the comparator for outputting the control signal having one of a high level and a low level in response to an output voltage of the comparator.

4. The display apparatus of claim 1, wherein the driving voltage is an analog source voltage, the grayscale voltage being generated using the analog source voltage.

5. The display apparatus of claim 1, wherein the control signal is applied to a reset terminal of the timing controller and the timing controller controls an output of the image data based on the control signal.

6. The display apparatus of claim 5, wherein the control signal is concurrently applied to the reset terminal of the timing controller and to an enable terminal of the voltage generator.

7. The display apparatus of claim 1, wherein the control signal is applied to an enable terminal of the voltage generator and the voltage generator controls an output of the driving voltage based on the control signal.

8. The display apparatus of claim 1, wherein when the load current voltage is more than the reference voltage, the voltage generator is shut down and the output of the driving voltage is blocked.

* * * * *